US009022603B1

(12) United States Patent
Moghal et al.

(10) Patent No.: US 9,022,603 B1
(45) Date of Patent: May 5, 2015

(54) SYSTEMS, METHODS, AND DEVICES FOR SEALING LED LIGHT SOURCES IN A LIGHT MODULE

(75) Inventors: Khurram Zeshan Moghal, Senoia, GA (US); Hung T. Dinh, Lawrenceville, GA (US)

(73) Assignee: Cooper Technologies Company, Houston, TX (US)

( * ) Notice: Subject to any disclaimer, the term of this patent is extended or adjusted under 35 U.S.C. 154(b) by 415 days.

(21) Appl. No.: 13/462,326

(22) Filed: May 2, 2012

Related U.S. Application Data

(60) Provisional application No. 61/485,775, filed on May 13, 2011.

(51) Int. Cl.
*F21V 21/00* (2006.01)
*F21V 17/10* (2006.01)

(52) U.S. Cl.
CPC ..... *F21V 17/101* (2013.01)

(58) Field of Classification Search
USPC ..... 362/217.02, 217.1, 221, 244, 249.02, 362/267
See application file for complete search history.

(56) References Cited

U.S. PATENT DOCUMENTS 7,857,482 B2 * 12/2010 Reo et al. ..... 362/249.02
8,545,049 B2 10/2013 Davis et al.
2008/0273327 A1 * 11/2008 Wilcox et al. ..... 362/267

* cited by examiner

*Primary Examiner* — Stephen F Husar
(74) *Attorney, Agent, or Firm* — King & Spalding LLP

(57) ABSTRACT

A light module includes circuit board with a top and bottom side. Multiple light emitting diodes (LEDs) are positioned along the top side of the circuit board. A bottom side of a gas permeable layer of material having top and bottom sides is adhered to at least a portion of the top side of the circuit board. A pair of elongated double-sided adhesive strips are coupled to the top side of the gas-permeable material near opposing ends of the circuit board. An optical lenses is positioned over each of the LEDs. A cover panel is then positioned over the circuit board, the first layer of material, the adhesive strips and at least a portion of each optic and adhered to top side of each of the elongated adhesive strips. Each lens includes an optical cavity and a recessed area adjacent the optical cavity for receiving a reflector therein.

15 Claims, 11 Drawing Sheets

SYSTEMS, METHODS, AND DEVICES FOR SEALING LED LIGHT SOURCES IN A LIGHT MODULE

RELATED PATENT APPLICATION

This application claims priority under 35 U.S.C. §119 to U.S. Provisional Patent Application Ser. No. 61/485,775, filed May 13, 2011, and titled "Systems, Methods, and Devices for Sealing LED Light Sources in a Light Module," the entire contents of which are hereby incorporated herein by reference for all purposes.

TECHNICAL FIELD

The technical field relates generally to light emitting diode ("LED") light module construction, and more particularly to systems, methods, and devices for sealing light modules containing one or more LED light sources.

BACKGROUND OF THE INVENTION

There are many advantages to the use of light emitting diode (LED) die packages as light sources in light fixtures to produce light efficiently. Many light fixtures have incorporated arrays of LED light sources often configured in a bar-shaped housing or module (also referred to as a "light bar" or LightBAR™).

A light bar often includes an extruded or die-cast bar of aluminum or other thermally conductive material to which the LEDs are bonded directly. This heat dissipating carrier to which the LEDs are attached is typically made of metal, such as a heat conductive aluminum alloy, and may provide heat dissipation to allow proper cooling of the LED, or may have an additional heat sink or other heat dissipating means attached. In most light bars the printed circuit board connects the LEDs to a power source. Often the circuit board is laminated to the extruded or die-cast bar. The light bars may further include circuitry to drive the LEDs included in one or more arrays of LED light sources. Typically, the LED arrays are made up of LED die packages that each include an LED light source with a lens (or primary optic), where each of the LED die packages are in turn associated with an optical system (or secondary optic) to control and/or maximize the light emitted from the LED package. In other configurations the LED light source may only have one over-optic to refract light. The light bars may further include circuitry to drive the LEDs included in the array. Each of the secondary optics aligned with the LED light source may be varied in shape and/or individually rotated to create a beam pattern for the array that is unique from the devices themselves, including all degrees of freedom, e.g. separately determined translation, tilt, and yaw for each lens. The array could comprise similarly colored LEDs, white or otherwise, or various colored LEDs.

Light bars are often shown as a rectangular flat bar, but can assume any two dimensional planar shape, such as square, circular, hexagonal, triangular or an arbitrary free-form shape. The light bar, either individually or combined with other light bars, can be the basis of a luminaire that is used for street lighting, pathway lighting, parking structure lighting, decorative lighting and any other type of spread beam application. With the heat sinking and power incorporated on or into the light bar, the light bar can be incorporated into existing luminaires or integrated into new luminaire designs.

Light bars provide the ability to generate a particular beam pattern with an array of LEDs which are mounted on a flat or planar plate, which most likely would be parallel to the street or floor. Light bars also provide thermal and electrical distribution required for the LEDs as well as provide means for protecting the array of LEDs from environmental damage. Conventional methods of sealing against water and dust intrusion for the coupling of the LED die package and the secondary optical system have included the use of elastomers (e.g., silicone adhesives) in combination with gasketing material along the entire interior of the light bar. However, the process typically includes several layers to insure a good seal. These multiple layers and the inclusion of the gasket material along the majority of the interior results in a light bar that must have a greater depth. The increased depth cause the cover portion of the light bar to be higher in relation to the positioning of the individual LEDs. This results in a portion of the light being emitted by the LEDs to be cut-off and not distributed to the illuminated area.

SUMMARY

According to one exemplary embodiment, a light module can include a substrate with a top side and an opposing bottom side. One or more LEDs can be coupled to the top side of the substrate. A first later of material can be coupled to the substrate. The first layer of material can have a top side and opposing bottom side, with the bottom side of the first material being coupled to the top side of the substrate. Elongated, double-sided adhesive strips can be coupled to the top side of the first layer of material. Multiple optical lenses can be coupled to portions of the top side of the first layer of material, each optical lens covering one or more of the LEDs. A cover panel can then be coupled to the top side of the double sided adhesive strips to adhere the cover panel to the substrate.

According to another exemplary embodiment, an illumination device can include a substrate and an LED. The LED can be electrically coupled to the substrate and positioned along a surface of the substrate. The device an also include an optic that is positioned about at least a portion of the LED. The optic can include an optical cavity that is defined by an inner surface of the optic. The optic can also include a heat deformable standoff that is positioned near the inner surface of the optic. The optic can further include a recessed area that is positioned within the inner surface of the optic near the optical cavity. The device can also include a reflector. At least a portion of the reflector can be positioned within the recessed area. The reflector can include a top end and a bottom end. The bottom end of the reflector can include a chamfered edge that is disposed adjacent to the inner surface of the optic and designed to receive a portion of the heat deformable standoff.

These and other aspects, features, and embodiments will become apparent to a person of ordinary skill in the art upon consideration of the following detailed description of illustrated exemplary embodiments exemplifying the best mode for carrying out the invention as presently perceived.

BRIEF DESCRIPTION OF THE DRAWINGS

Reference will now be made to the accompanying drawings, which are not necessarily drawn to scale, and wherein.

Figure 1:
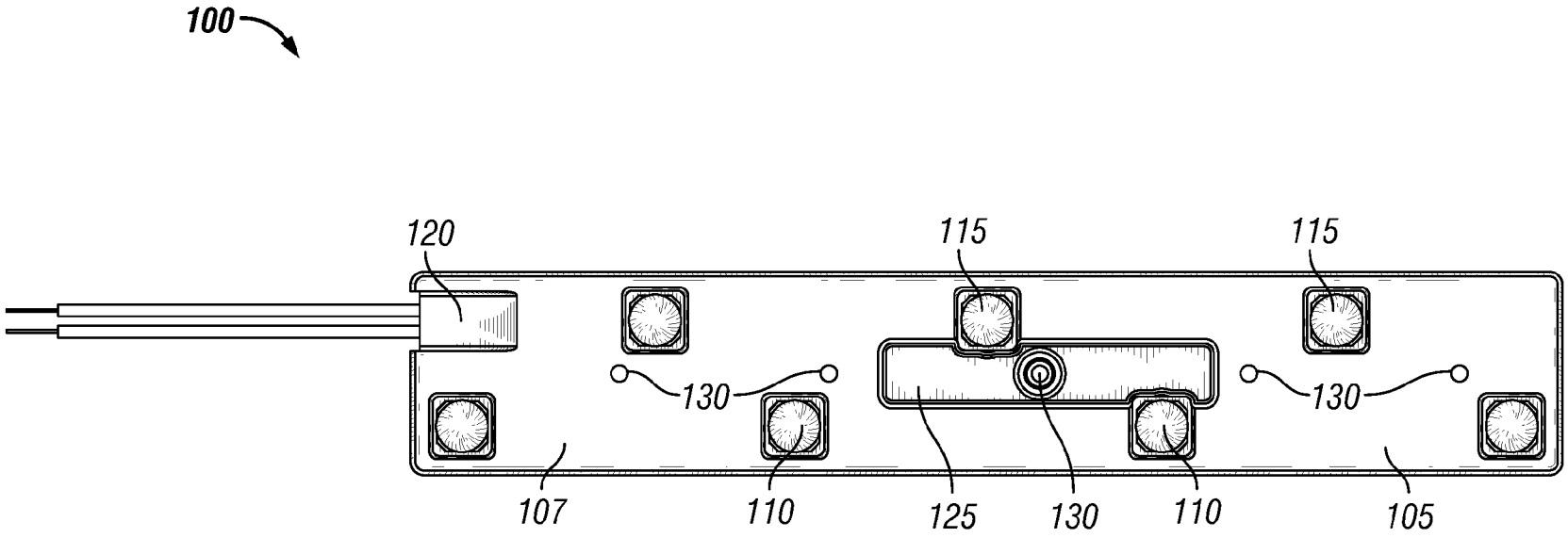
FIG. 1 is a top plan view of an LED light bar in accordance with one exemplary embodiment.

The drawings illustrate only exemplary embodiments of the invention and are therefore not to be considered limiting of its scope, as the invention may admit to other equally effective embodiments. The elements and features shown in the drawings are not necessarily to scale, emphasis instead being placed upon clearly illustrating the principles of the exemplary embodiments. Additionally, certain dimensions or positionings may be exaggerated to help visually convey such principles. In the drawings, reference numerals designate like or corresponding, but not necessarily identical, elements.

DETAILED DESCRIPTION OF THE EXEMPLARY EMBODIMENTS

One or more of the exemplary embodiments described herein are directed to an LED light bar. In addition, one or more of the exemplary embodiments described herein are directed to fixing optical components over LED die packages for light modules such as LED light bars incorporated into light fixtures while maintaining environmental protection for the light bar. The seal or bond provided by the various exemplary embodiments of the invention may be such that the seal or bond satisfies ingress protection (IP) standards established to ensure component protection from various environmental elements (e.g., water, dirt, etc.). According to some exemplary embodiments, a primary lens is disposed over and around or about one or more LEDs or LED die packages and a secondary lens is disposed over and around or about one or more primary lens. The primary lens is sometime referred to as a protective dome for individual or groups of LEDs. The terms "optic" and "lens" as used herein and described in the exemplary embodiments can refer to either the primary or the secondary lens. Furthermore, one or more of the exemplary embodiments described herein are directed to the positioning and adhering of mirrors inside of an optic.

The exemplary embodiments now will be described more fully hereinafter with reference to the accompanying drawings, in which the exemplary embodiments are shown. This invention may, however, be embodied in many different forms and should not be construed as limited to the exemplary embodiments set forth herein; rather, these exemplary embodiments are provided so that this disclosure will be thorough and complete, and will fully convey the scope of the invention to persons having ordinary skill in the art. Like numbers refer to like, but not necessarily the same or identical, elements throughout.

FIG. 1 is a perspective view of an LED light module or light bar 100 (hereinafter referred to as a "light bar" or "bar" or "light module" in accordance with an exemplary embodiment. FIGS. 2A-D are various exploded views of the exemplary light bar 100 of FIG. 1. Referring now to FIGS. 1-2D, the exemplary light bar 100 includes a light bar housing 105 and one or more optics 110. The light bar housing 105 includes a cover panel 107 that covers one side of a common substrate 210. In one exemplary embodiment, the cover panel 107 is made of metal or metal alloy and in certain exemplary embodiments, the cover panel 107 is made of sheet metal. However, other metallic and non-metallic materials can be used to form the cover panel 107.

The cover panel 107 includes multiple apertures 115, a first raised area 120 and a second raised area 125. In one exemplary embodiment, the cover panel 107 includes 7 staggered apertures 115 positioned along two rows. Each aperture 115 provides an opening or light window for the pass-through of light emitted by one or more LEDs or LED packages on the common substrate 210. The exemplary apertures 115 are sized and shaped to allow for a portion of the optics 110 to extend beyond the surface of the cover panel 107. In certain exemplary embodiments, the first raised area 120 is sized and shaped to allow wires 280, 290 to electrically and/or mechanically couple to the common substrate 210 at contacts 245, 255. In certain exemplary embodiments, the wires 280, 290 are coupled to the contacts 245, 255 with solder or other known coupling means, such as a push in connector or male or female plug. The second raised area 125 is sized and shaped to provide room for one or more electrical components 260 for driving or controlling the light output of the light bar 100. In addition, the cover panel 107 includes one or more apertures or through-holes 130 sized and shaped to receive a coupling device, such as a screw, bolt, or rivet, therethrough, for coupling the light bar 100 to a heat sink or other surface.

The common substrate 210 includes one or more LEDs, LED die packages, or chip on board LEDs 220 (collectively referred to herein as LEDs) mounted to the common substrate 210. According to some exemplary embodiments, the common substrate 210, hereinafter referred to as a printed circuit board or PC board, includes one or more sheets of ceramic, metal, laminate, circuit board, Mylar®, or another material. The PC board 210 also includes several apertures or through-holes 212 sized and shaped to receive the coupling device discussed with reference to element 130 above for coupling the light bar 100 to a heat sink or other surface. According to one exemplary embodiment, the apertures 212 lie axially and centrally along the length of the PC board 210 and are aligned with the apertures 130. However, these apertures 212 can lie in a different pattern in other exemplary embodiments. The PC board 210 provides a convenient means to provide power to the LEDs 220 and is known to people having ordinary skill in the art. However, other means for conveying power to the LEDs 220 also are contemplated herein, for example, connectors, sockets, plugs, direct wiring, and other means known to people having ordinary skill in the art.

Each LED 220 includes at least one chip of semi-conductive material that is treated to create a positive-negative ("p-n") junction. When the LED 220 is electrically coupled to a power source, such as a driver (not shown) by way of the wires 280, 290, current flows from the positive side to the negative side of each junction, causing charge carriers to release energy in the form of incoherent light. In the exemplary embodiment of FIG. 1, the LEDs 220 are disposed along the substrate 210 in an array having seven total LEDs 220. The seven LEDs 220 are in a two row, staggered position layout. The staggered positioning of the LEDs reduces the amount of cutoff that can be caused by adjacent LEDs 220 and optics 115 that intercept some of the light being emitted from adjacent LEDs 220 and thereby cause shadowing and/or dark areas on the area intended to be illuminated by the light bar 100.

An adhesive layer 270 is disposed between the surface of the PC board 210 and at least a flange portion 202 of one or more optics 110 that are disposed over each LED 220. One example of the adhesive layer 270 is a high performance, double-sided tape. In an alternative embodiment, a viscous or semi-viscous adhesive is applied to the bottom side of the gas-permeable layer 230 instead of using double-sided tape. A bottom surface of the adhesive layer 270 adheres to the surface of the substrate 210, while at least a portion of a top surface 245 of the adhesive layer 270 is not covered by a gas permeable layer 230 and instead provides an area 245 for adhering the flange of the optic 110 to the adhesive layer 270. In certain exemplary embodiments, the double-sided tape for the adhesive layer 270 is made of FLEXMOUNT L606 manufactured by FLEXCON; however, other similar products may be substituted for the exemplary material. In certain exemplary embodiments, the adhesive layer 270 protects the LEDs 220 and the PC board 210 from environmental contaminants.

Coupled to the top side of the adhesive layer 270 is one or more gas-permeable layers 230 that allow air and/or other gases to permeate or pass therethrough. Specifically, the gas permeable layer 230 facilitates the exchange of air or gas between the area surrounding the LED 220 and the exterior of the light bar 100. While the exemplary embodiment includes a gas-permeable layer 230, in alternative embodiments, this layer is not gas-permeable. However, the use of this non-gas-permeable layer is substantially the same as that described herein with regard to the gas-permeable layer and, for the sake of brevity, will not be repeated. Some examples of gas-permeable layers 230 include, but are not limited to, Tyvek®, high density polyethylene, burlap, canvas, silicone, and other gas-permeable materials known to people having ordinary skill in the art. In certain exemplary embodiments, the adhesive layer 270 and the gas-permeable layer 230 have substantially the same profile, in that all or most of the bottom side of the gas permeable layer 230 is covered by the adhesive layer 270.

Both the gas-permeable layer 230 and the adhesive layer 270 include corresponding apertures 235. The apertures 235 are generally configured to align with the LEDs 220 when the adhesive layer 270 and the gas-permeable layer 230 are coupled to the top side of the substrate 210. In certain embodiments, the apertures 235 for the gas-permeable layer 230 are larger than the apertures 235 for the adhesive layer 270, so that the optics 110 can also be press-fitted onto the adhesive layer 270. Each of the gas-permeable layer 230 and adhesive layer 270 can also include apertures 285 that correspond to one another and correspond to the position of the electrical components 260 on the substrate 210, such that when the adhesive layer 270 is applied to the top surface of the substrate 210, the electrical components 260 extend up through the adhesive layer 270 and the gas-permeable layer 230. Further, each of the gas-permeable layer 230 and adhesive layer 270 can also include multiple apertures 295 that correspond to one another and correspond to the position of the apertures 130 and 212 for receiving a coupling device, such as a screw, therethrough, for coupling the light bar 100 to a heat sink or other surface. In certain exemplary embodiments, the combined gas-permeable layer 230 and the adhesive layer 270 protects the LEDs 220 and the PC board 210 from environmental contaminants.

Figure 2A:
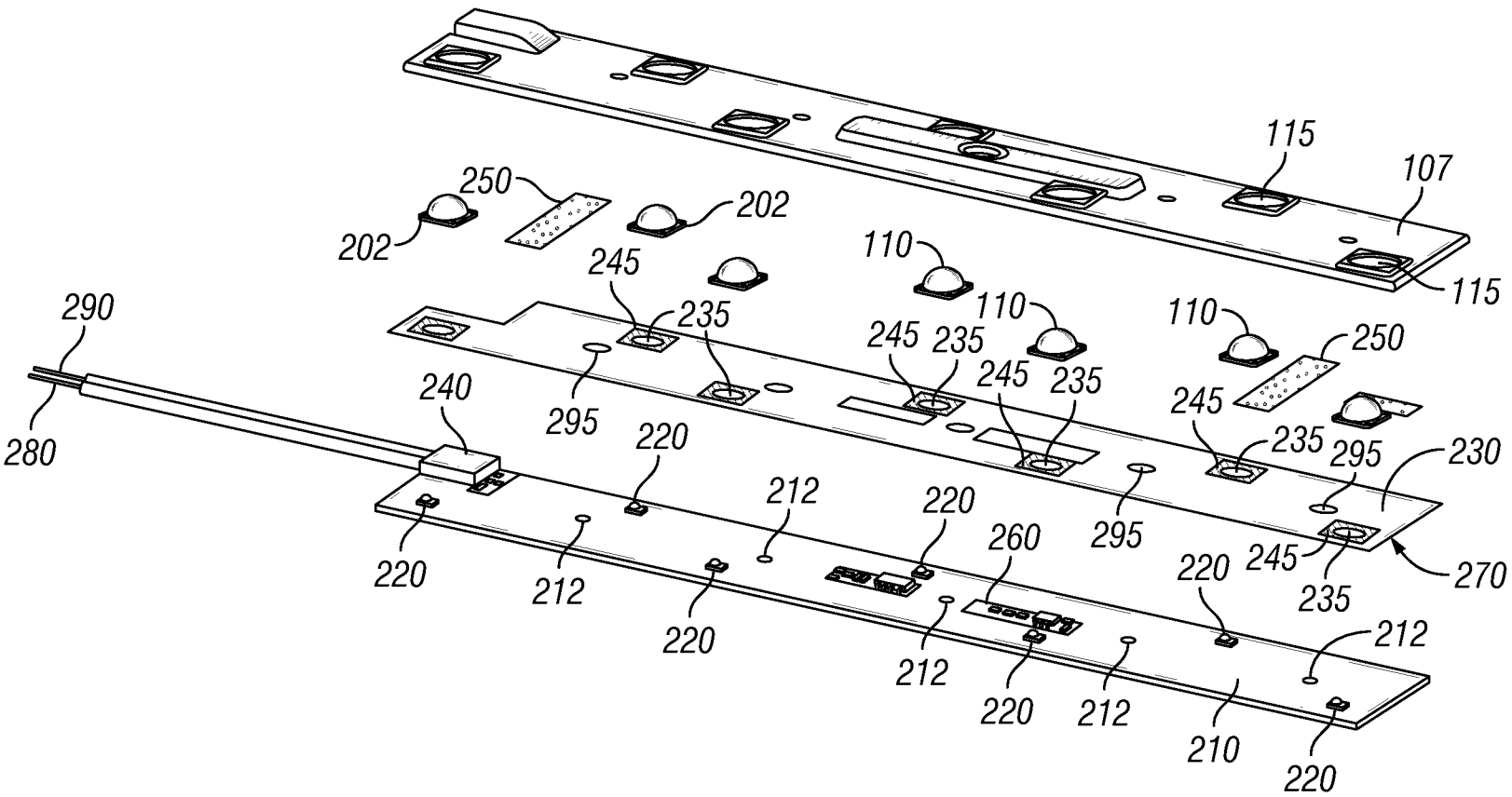
FIGS. 2A-D are various exploded views of the exemplary light bar of FIG. 1 in accordance with an exemplary embodiment.
Figure 2B:
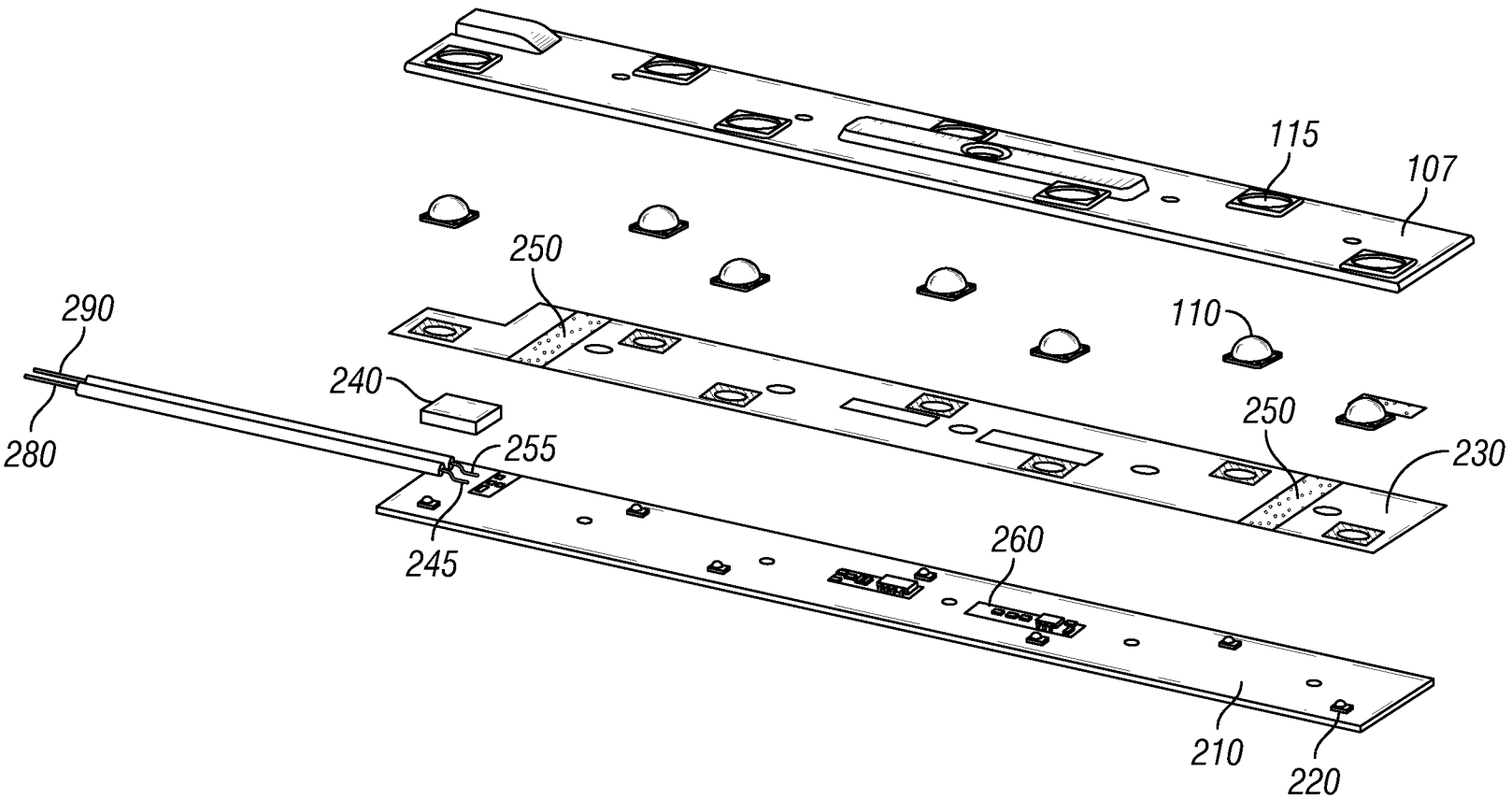
Figure 2C:
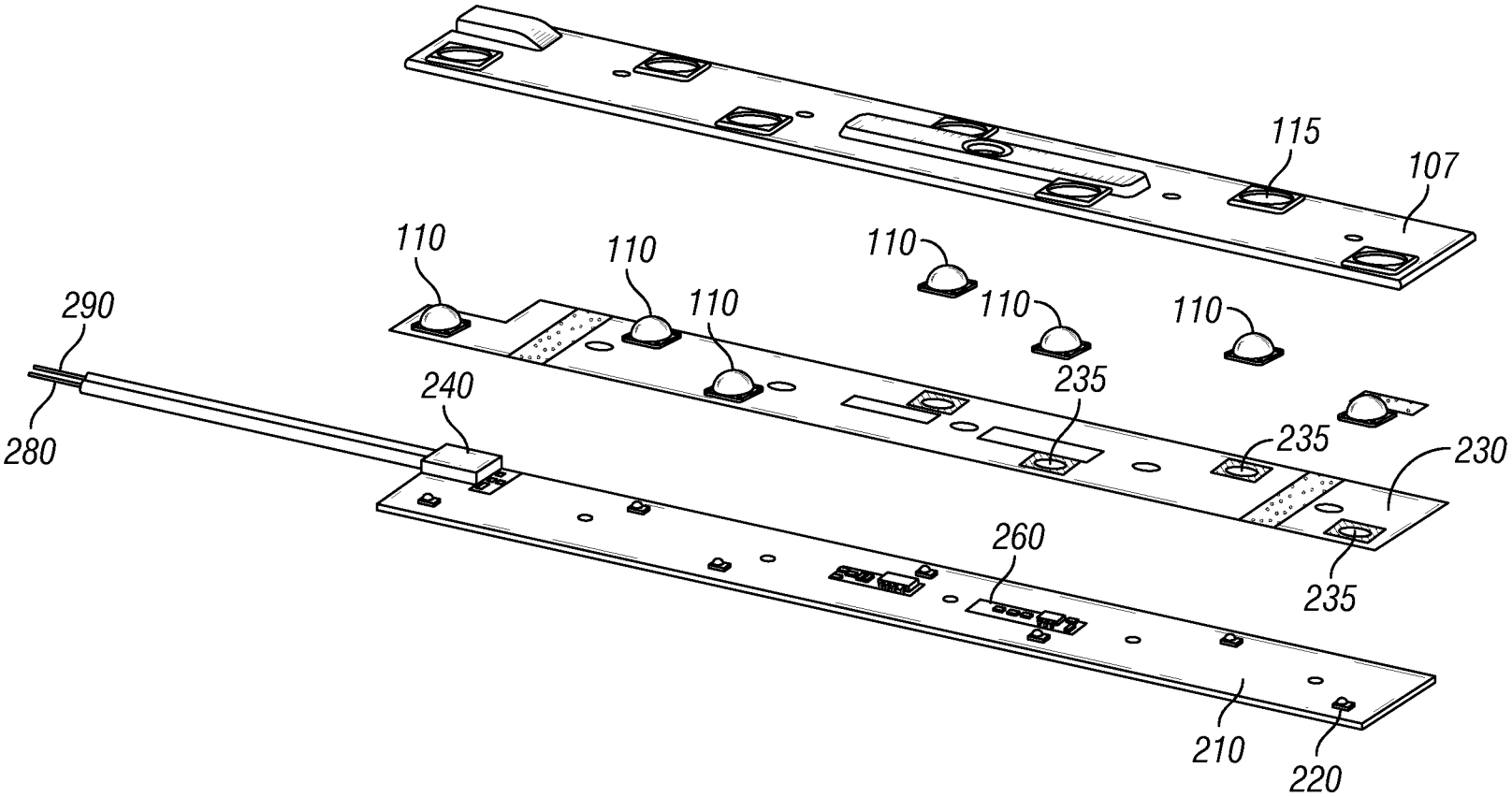
Figure 2D:
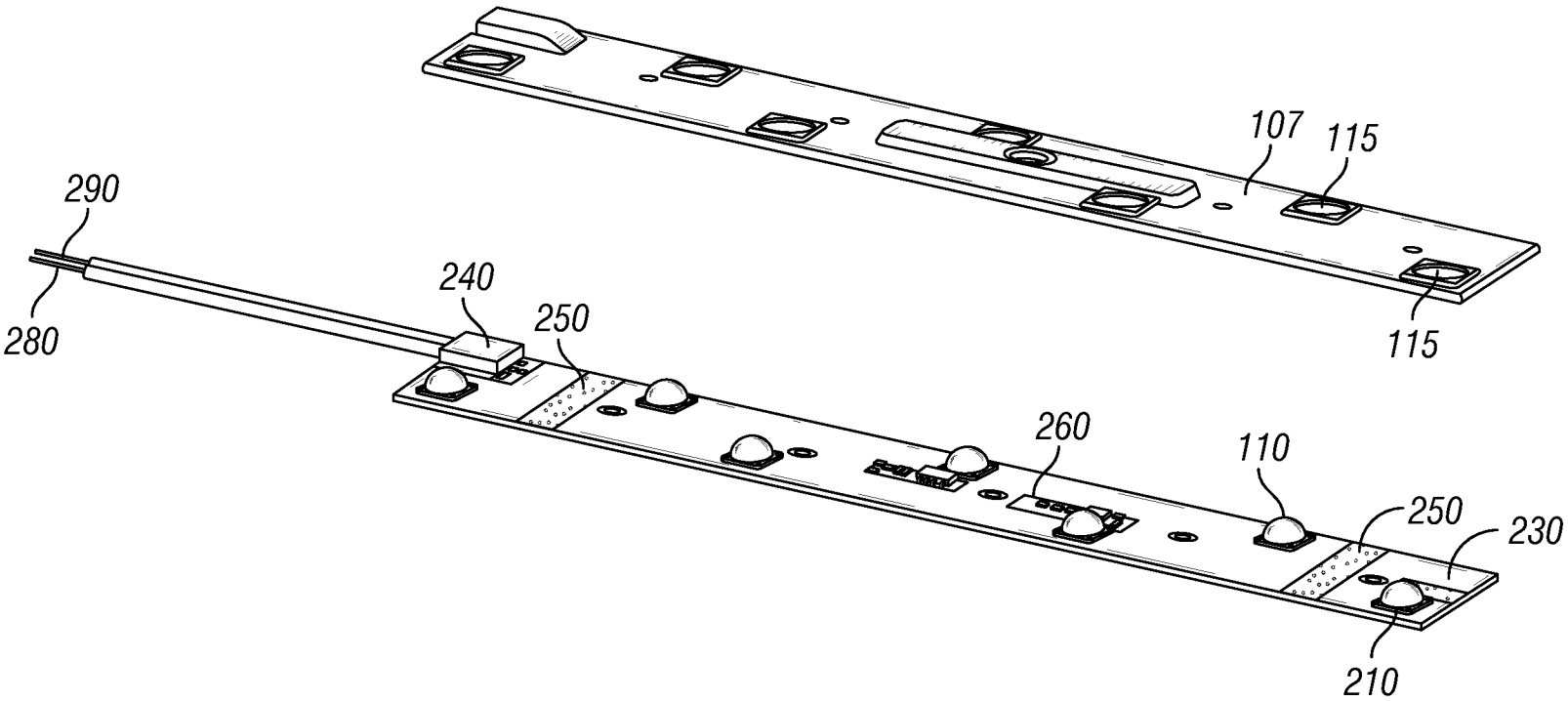

One or more adhesive strips 250 are disposed between the gas-permeable layer 230 and the cover 120 and positioned generally near the opposing ends of the gas-permeable layer (as shown in FIG. 2C). While the exemplary embodiment shows two adhesive strips, in alternative embodiments anywhere from 1-100 strips 250 can be used depending on the needs or desires of the designer. Further, in another alternative embodiment, instead of a pair of adhesive strips 250, another adhesive layer, similar in size and shape as the gas-permeable layer 230 could be substituted for the strips and cover all or substantially all of the to surface of the gas-permeable layer. One example of the adhesive strip 250 is a high performance, double-sided tape. In an alternative embodiment, a viscous or semi-viscous adhesive is applied to the top side of the gas-permeable layer 230 instead of using double-sided tape for the adhesive strips 250. A bottom surface of the adhesive strip 250 adheres to the surface of the gas-permeable layer 230 and a top surface of the adhesive strip 250 adheres to the bottom side of the cover panel 107. In constructing the light bar 100, the cover panel 107 is pressed down over the substrate 210, the optics 110 and the gas-permeable layer 230 and the adhesive strips 250 adhere to the bottom side of the cover panel and hold the cover panel 107 in place over at least the top side of the substrate. While the exemplary strips 250 are shown to have a rectangular shape, other geometric and non geometric shapes can be used and are contemplated within the scope of this disclosure. Further, while the exemplary embodiment shows the adhesive strips 250 being applied latitudinally along opposing ends of the gas-permeably layer 230, those of ordinary skill in the art will recognize that the strips 250 could also be placed longitudinally, such as along opposite longitudinal sides of the gas-permeable layer 230 and still function to hold the cover panel 107 in place on the light bar 100. In certain exemplary embodiments, the double-sided tape for the adhesive strips 250 can be made of any acrylic-based adhesive including, but not limited to, FLEXMOUNT L606 manufactured by FLEXCON or VHB tape manufactured by 3M.

In certain exemplary embodiments, the light bar 100 also includes a gasket 240. The gasket is sized and shaped to fit within the first raised surface 120 and is positioned generally between the bottom surface of the cover panel 107 and the area where the wires 280, 290 are coupled to the contacts 245, 255. Further the gasket can also cover any other portion of the wires 280, 290 that are under the cover panel 107 to prevent the cover panel 107 from wearing the insulation off of the wires 280, 290 and causing a short-circuit between one of the wires and the cover panel 107. In one exemplary embodiment, the gasket 240 has a substantially rectangular shape; however, are geometric and non-geometric shaped gaskets can be substituted without departing from the scope or spirit of this disclosure. Examples of the material used to make the gasket include, but are not limited to, silicone, rubber, ethylene propylene diene monomer (M-class) rubber (EPDM), and neoprene.

The optic 110 includes the flange portion 202 and is disposed over the LED 220. The optic 110 receives the light emitted from the LED 220 and distributes the light to a desired illumination area. The optic 110 can be disposed over either a single LED 220 or multiple LEDs 220 (not shown). According to some exemplary embodiments, the optic 110 is designed to receive light from the LED 220 that the optic 110 is disposed over and direct light to the desired illumination area in a predetermined manner, which includes one or more of direction, pattern, and intensity. Each optic 110 used in the light bar 100 is designed the same according to some exemplary embodiments, while one or more optics 110 are designed differently than another optic 110 used in the same light bar 100 in accordance with other exemplary embodiments. The exemplary optic 110 is typically fabricated using an acrylic or polycarbonate material or glass. However, the optic 110 can be fabricated using other transparent or translucent material, such as glass. In certain exemplary embodiments, each optic 110 or the group of optics 110 collectively can be configured to provide Type I, II, III, IV, or V exterior light distribution patterns, as that term is understood by those or ordinary skill in the art.

Figure 3:
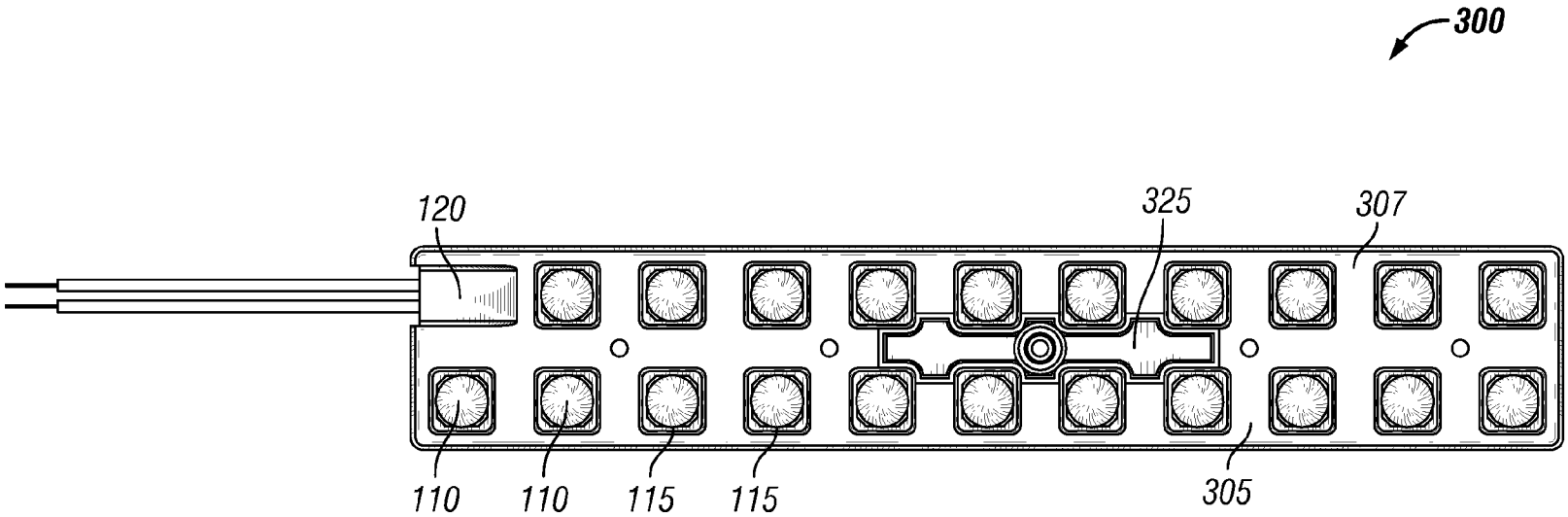
FIG. 3 is a top plan view of another LED light bar in accordance with an alternative exemplary embodiment.
Figure 4:
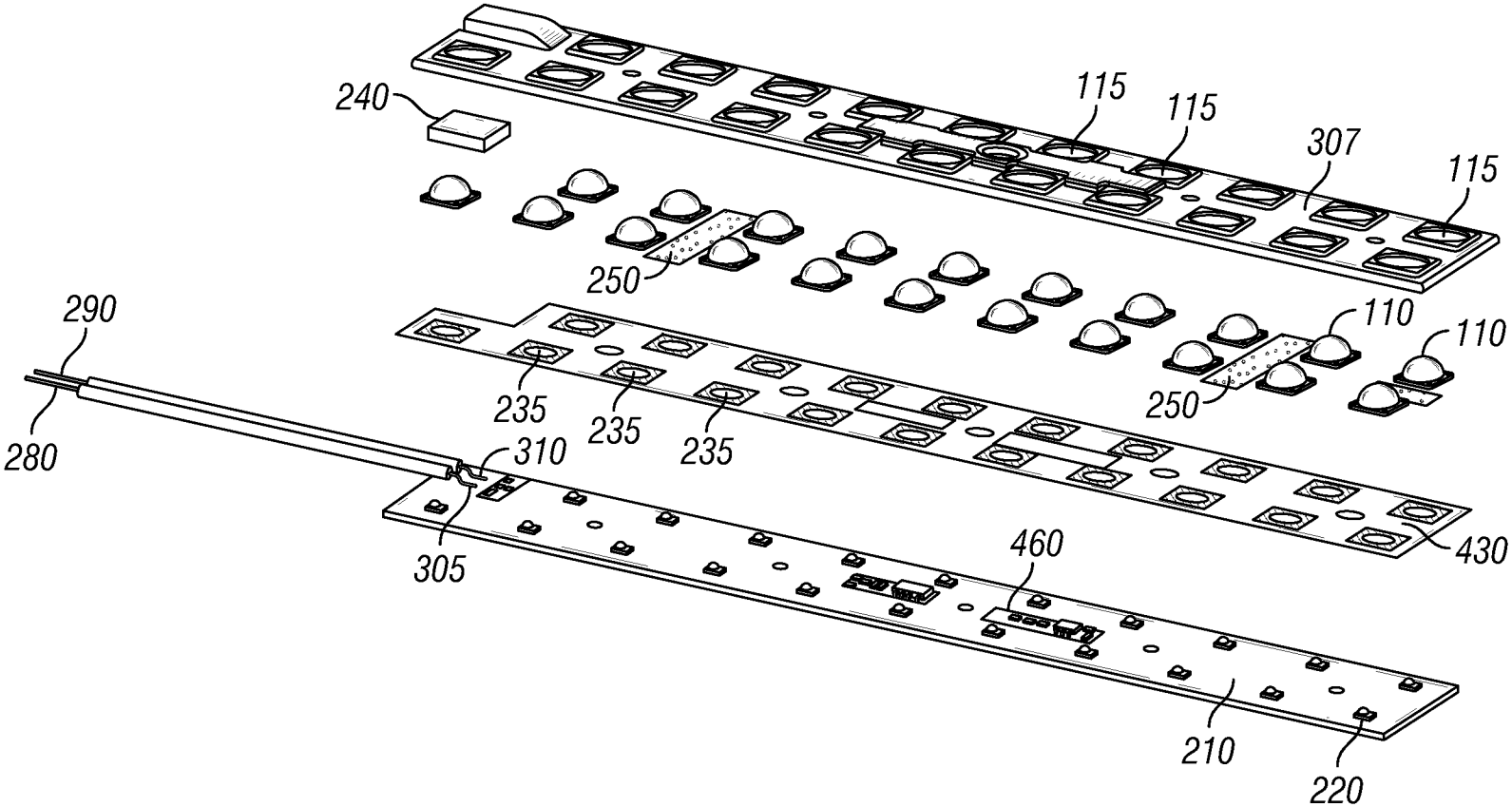
FIG. 4 is an exploded view of the exemplary light bar of FIG. 3, in accordance with the alternative exemplary embodiment.

FIG. 3 is a top plan view of another exemplary light bar 300 in accordance with an alternative exemplary embodiment. FIG. 4 is an exploded view of the exemplary light bar 300 of FIG. 3. Now referring to FIGS. 3 and 4, the exemplary light bar 300 is substantially similar to the light bar 100 of FIGS. 1-2D. However, instead of seven LEDs, the exemplary light bar 300 includes 21 LEDs 220. Therefore the cover panel 307 includes twenty-one apertures 115 for receiving the twenty-one optics 115 therethrough. Further, with the additional apertures, the shape of the second raised area 325 is somewhat different. The second raised area 325 is sized and shaped to provide room for one or more electrical components 460 for driving or controlling the light output of the light bar 100 as well as the optics 110 and apertures 115. The electrical components and circuitry 460 can be different, larger or more numerous in order to power or "drive" twenty-one LEDs 220 instead of seven. The gas-permeable layer 430 and the adhesive layer on the bottom side of the gas-permeable layer have twenty-one apertures in this embodiment instead of seven as with the light bar 100 of FIGS. 1-2D. Otherwise the remaining elements of the two exemplary light bars 100, 300 are generally the same and, for the sake of brevity, will not be repeated for the exemplary light bar 300.

Figure 5:
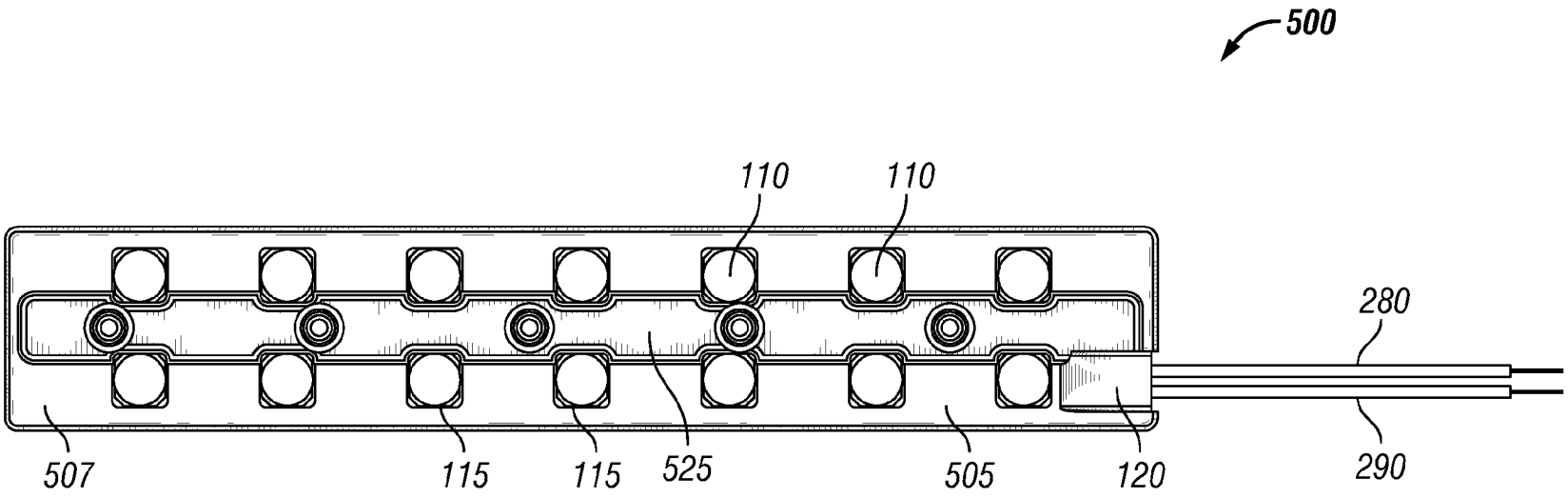
FIG. 5 is a top plan view of another exemplary light bar, in accordance with an alternative exemplary embodiment.

FIG. 5 is a top plan view of yet another exemplary light bar 500 in accordance with another alternative exemplary embodiment. Referring to FIG. 5, the exemplary light bar 600 is substantially similar to the light bars 100 and 300 of FIGS. 1-4. Instead of seven or twenty-one LEDs, the light bar 500 includes fourteen LEDs 220 disposed in two parallel rows of seven LEDs 220. Therefore the cover panel 507 includes fourteen apertures 115 for receiving the fourteen optics 115 therethrough. Further, with the additional apertures the shape of the second raised area 525 is somewhat different and can be shortened similar to the raised areas 125 or 325 of FIGS. 1 and 3. The electrical components and circuitry can be different or more or less numerous in order to power or drive fourteen LEDs 220 instead of seven or twenty-one. The internal make-up of the light bar 500, including the gas-permeable layer, the adhesive layer, and the adhesive strips is substantially the same except for the number of apertures needed for the LEDs 220. Otherwise the remaining elements of the exemplary light bar 500 is substantially the same as the exemplary light bars 100, 300, 500 and, for the sake of brevity, will not be repeated for the exemplary light bar 500.

Figure 6A:
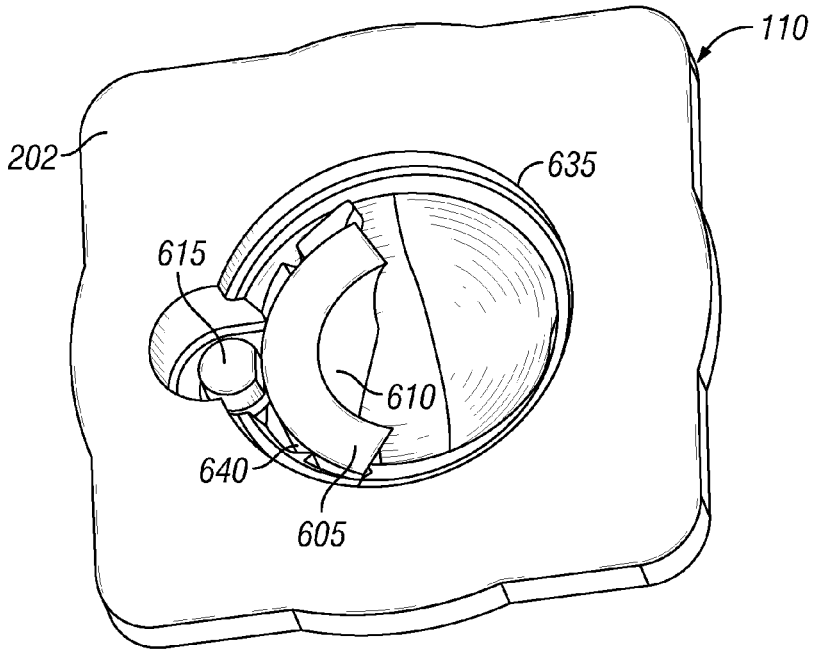
FIG. 6A is a perspective view of the bottom side of an optic and mirror combination, in accordance with an exemplary embodiment.
Figure 6B:
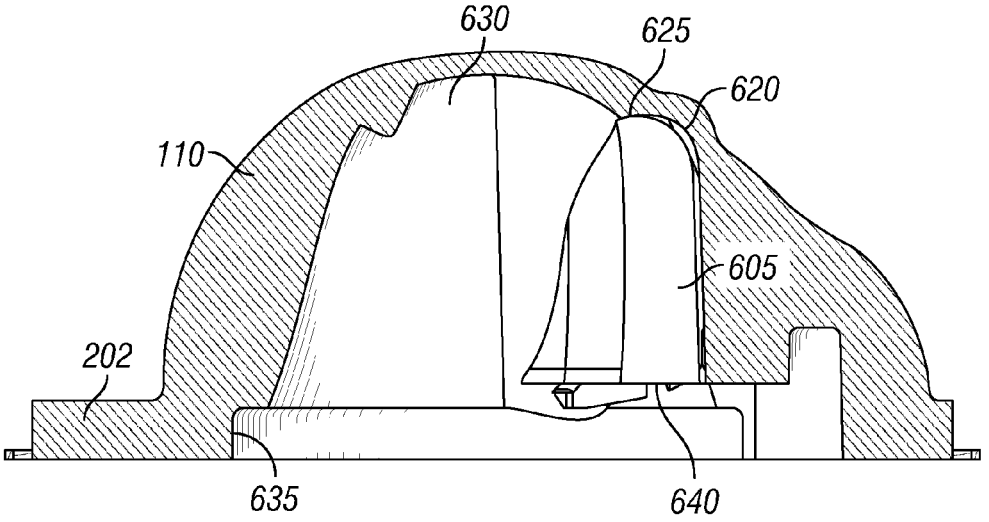
FIG. 6B is a cross-sectional view of the optic and mirror combination of FIG. 6A, in accordance with an exemplary embodiment.

FIGS. 6A and 6B present different views of the exemplary optic 110 according to one exemplary embodiment of the present invention. Referring now to FIGS. 6A-B, as previously mentioned, the exemplary optic 110 is made of acrylic and can represent one or more optical devices disposed over each LED 220. For example, the optic can be described as being positioned over, about or adjacent to the LED 220 and the PC board or substrate 210. In addition, in certain exemplary embodiments, each optic includes one or more reflectors or mirrors 605. At least a portion of each reflector 605 is disposed within the optical cavity 630 of the optic 110. In certain exemplary embodiments, the optical cavity 630 has a volume defined by an inner surface of the optic 110. According to some exemplary embodiments, each reflector 605 is disposed along an inner surface of the optic 110 which can also generally be described as the exterior of the optical cavity 630 for each optic 110. Each reflector 605 has a front side 610 that is highly reflective and faces into the optical cavity 630 of the optic 110.

The exemplary optic 110 includes a standoff 615. In one exemplary embodiment, the standoff 615 is a cylindrical, circular, or other shaped portion of the optic 110 made from acrylic and disposed at or adjacent to the edge of the optical cavity 630 near the widest portion 635 of the optical cavity 630. During assembly of the mirror into the optical cavity 630, the standoff 615 is heated to soften and deform, or melt all or a portion of the standoff 615 against a surface of the reflector 605 to fix the reflector 605 into the position and orientation within the optic 110. The optic 110 also includes a recessed area 620 along the side of the optic 115 and within the optical cavity 630. For example, the recessed area 620 is formed out of and disposed along or in the inner surface of the optic 110 and has a size and shape that is analogous to the size and shape of all or a portion of the reflector 605. The recessed area 620 is sized and shaped to receive all or a portion of the reflector 605. For example, the recessed area 620 is sized and shaped to receive the top side 625 of the reflector 605 and allow the reflector 605 to rest in the recess until the reflector 605 is permanently attached to the optic 110. While the reflector 605 is resting in the recess 620, a heat gun or other similar device is placed against the standoff 615 of the optic 110 adjacent to the bottom edge 640 of the reflector 605. The heat gun causes the standoff 615 to begin melting and slightly deforming. The back side of the reflector 605 adjacent the standoff 615 is then pressed against the melted portion of the standoff 615 until that area cools sufficiently to create a bond between the optic 110 and the reflector 605. This allows the reflector 605 to be placed within the optic 110 and properly positioned without the need for a flange on the reflector 605.

Figure 7A:
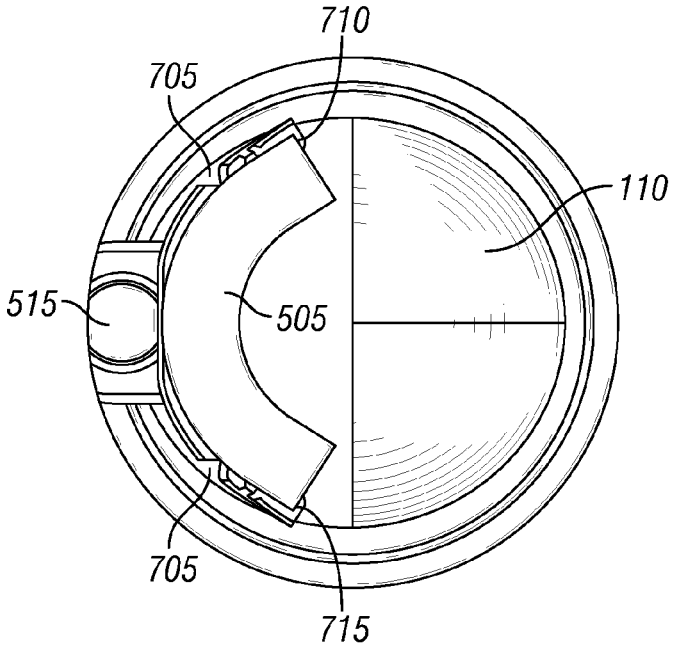
FIGS. 7A and 7B are additional views of the optic and mirror combination having exemplary ribs for positioning the mirror, in accordance with an exemplary embodiment.
Figure 7B:
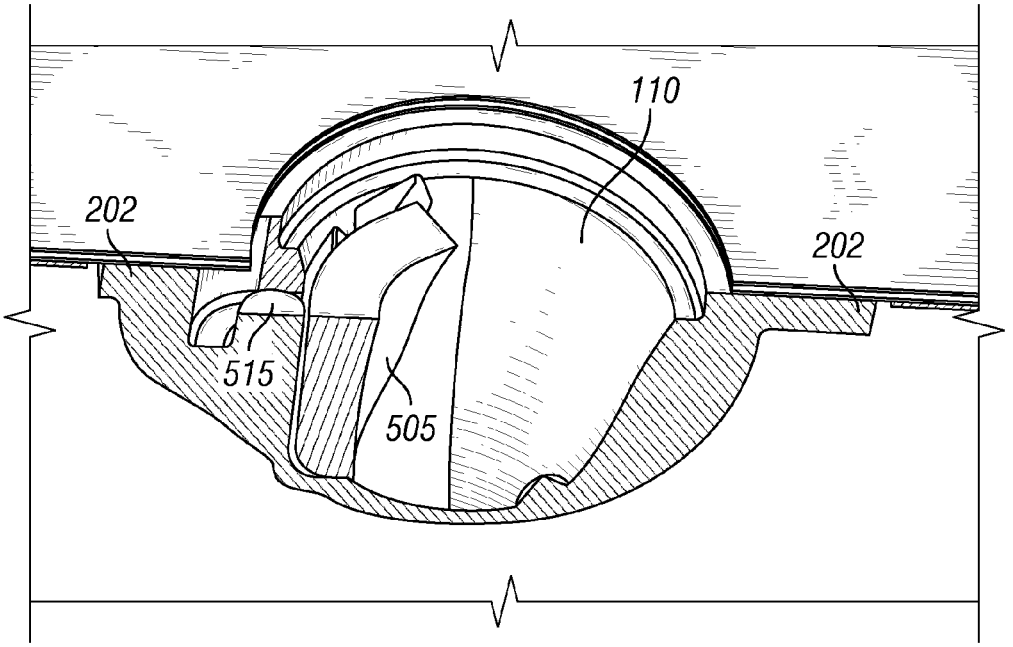

FIGS. 7A and 7B are additional views of the optic 110 and reflector 605 combination having exemplary ribs for positioning the reflector 605, in accordance with an exemplary embodiment of the present invention. Referring now to FIGS. 7A-B, the exemplary optic 110 includes one or more ribs 705 extending longitudinally along the substantially vertical portion of the recessed area 620 along the inner surface of the optic 110. In one exemplary embodiment the optic 110 includes two ribs 705, each rib being positioned adjacent to opposite ends 710, 715 of the reflector 605. Alternatively, greater or fewer than two ribs 705 can be provided in the recessed area 620. The ribs 705 are typically made from the same material as the optic 110, such as acrylic. However, other materials can be used to form the ribs 705. In one exemplary embodiment, the ribs 705 are integral with the optic 110 and formed in the same molding process as the optic 110. In one exemplary embodiment, the ribs 705 have a triangular cross-sectional shape; however, other geometric and non-geometric cross-sectional shapes can be used and are within the scope and spirit of this disclosure. The ribs 705 provide assistance in positioning the reflector 605 in the recessed area 620 of the optic 110. For example, as shown in FIGS. 7A-B. the ribs 705 make contact with the back side of the reflector 605 and place it in a predetermined position within the optical cavity 630 and a predetermined distance away from the inner side wall of the optic 110.

Figure 8A:
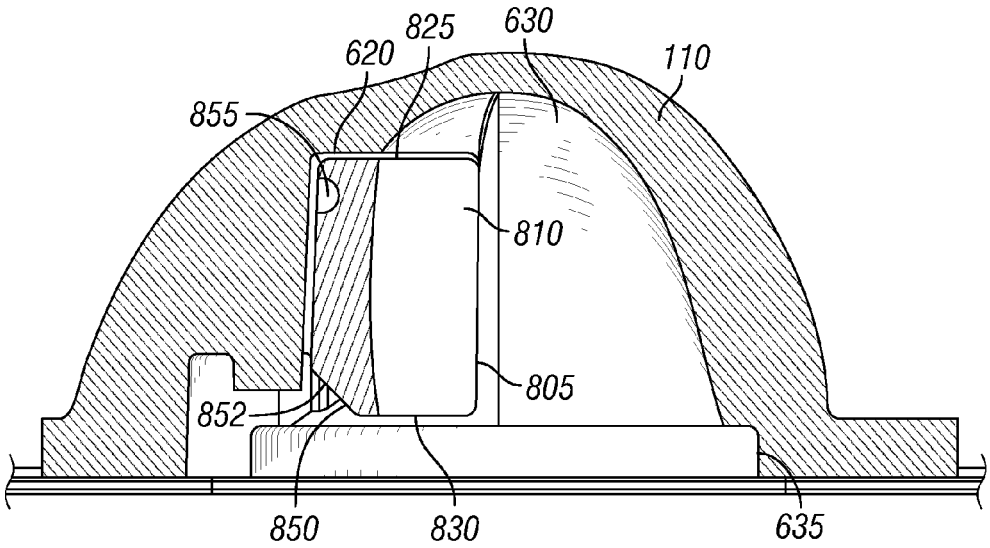
FIGS. 8A and 8B are cross-sectional and perspective views, respectively, of another optic and mirror combination in accordance with an alternative exemplary embodiment.
Figure 8B:
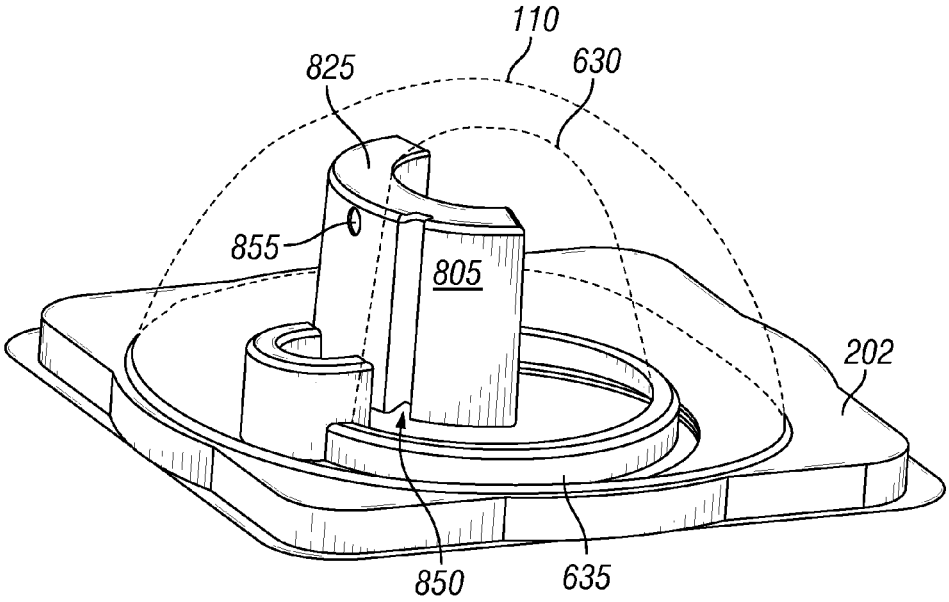

FIGS. 8A and 8B are cross-sectional and perspective views, respectively, of another optic and mirror combination in accordance with an alternative exemplary embodiment. Referring now to FIGS. 6-8B, the exemplary apparatus 800 is substantially similar to the optics and reflectors discussed in FIGS. 6-7B and only the differences will be described herein. The exemplary optic 110 includes the optical cavity 630 and the recessed area 620 disposed along an inner wall of the optic 110. A reflector 805 is positioned within the recessed area 620.

The reflector 805 includes a top side 825 and an opposing bottom side 830. A back side or surface 810 of the reflector 805 is positioned adjacent to the inner wall of the optic 110. In certain exemplary embodiments, the back side 810 abuts the inner wall of the optic 110. Alternatively, the back side 810 can be positioned against the ribs 705 as taught in FIGS. 7A and 7B. The reflector 805 includes a chamfered bottom section 850. In one exemplary embodiment, the chamfered section 850 extends from the bottom side 830 of the reflector 805 to the back side 810 of the reflector 805 to provide an increased amount of surface area 852 for receiving and adhering to the melted portion of the standoff 615. In practice, as the standoff 615 is melted, it pools up between the chamfered section 850 and the inner wall of the optic and then cools to adhere the reflector 805 to the optic 110. In certain exemplary embodiments, the chamfered section 850 has an angle between 15-85 degrees from the horizontal.

The exemplary reflector 805 also includes a position indicating recess 855 disposed generally near the top side 825 of the reflector 805. In certain exemplary embodiment, the position indicating recess is a void or removal of reflector material from the back side 810 of the reflector. Alternatively, a mark (such as an X or other letter or symbol) or color could be added near the top side 825 of the reflector 805 to similarly designate the top side 825 of the reflector 805. In one exemplary embodiment, the position indicating recess 855 is in the shape of a hemisphere.

Although exemplary embodiment have been described, it should be appreciated by those skilled in the art that various modifications are well within the scope of the invention. From the foregoing, it will be appreciated that an embodiment of the present invention overcomes the limitations of the prior art. Those skilled in the art will appreciate that the present invention is not limited to any specifically discussed application and that the exemplary embodiments described herein are illustrative and not restrictive. From the description of the exemplary embodiments, equivalents of the elements shown therein will suggest themselves to those skilled in the art, and ways of constructing other embodiments of the present invention will suggest themselves to practitioners of the art. Therefore, the scope of the present invention is not limited herein.

We claim:

1. A light module, comprising:

a substrate having a top side and an opposing bottom side;

a plurality of light emitting diodes (LEDs) coupled to the top side of the substrate;

a first layer of material having a top side and opposing bottom side, the bottom side of the first layer of material disposed along and coupled to the top side of the substrate;

at least two elongated adhesive strips coupled to the top side of the first layer of material a plurality of optical lenses, each lens disposed over at least one of the plurality of LEDs; and a cover panel disposed over the top side of the substrate and the top side of the first layer of material, the cover panel coupled to the elongated adhesive strips.

2. The light module of claim 1, wherein the first layer of material comprises:

an double-sided adhesive layer comprising a bottom side coupled to the substrate and an opposing top side; and a gas-permeable layer coupled to the top side of the double-sided adhesive layer.

3. The light module of claim 1, further comprising an adhesive layer of material disposed between the substrate and the first layer of material to couple the first layer of material to the substrate.

4. The light module of claim 3, wherein the adhesive material is silicone.

5. The light module of claim 3, wherein the adhesive material comprises double-sided tape.

6. The light module of claim 1, wherein each of the adhesive strips comprise double-sided tape.

7. The light module of claim 1, wherein the light module is coupled to a heat sink.

8. The light module of claim 1, wherein the substrate comprises a circuit board.

9. The light module of claim 1, wherein at least a portion of the lenses comprises:

a standoff portion; and a reflector coupled to an inner surface of the lens and disposed adjacent to the standoff portion within a cavity of the lens.

10. The light module of claim 9, wherein the at least a portion of the lenses further comprises:

an optical cavity defined by an inner surface of the lens;

a recessed area disposed within the inner surface of the lens adjacent the optical cavity, wherein the reflector is positionally received within the recessed area.

11. The light module of claim 9, wherein the reflector comprises a top end and an opposing bottom end, wherein the bottom end of the reflector comprises a chamfered edge disposed adjacent the inner surface of the lens and configured to receive at least a portion of a thermally deformed standoff portion.

12. The light module of claim 9, wherein the reflector comprises:

a top end;

an opposing bottom end;

a front reflective surface disposed between the top and bottom ends; and a back surface opposite the front reflective surface and comprising a position indicating recess defining a void in the back surface disposed adjacent to the top end of the reflector.

13. The light module of claim 9, wherein the reflector comprises a mirror.

14. The light module of claim 1, wherein the plurality of LEDs comprises seven LEDs.

15. The light module of claim 14, wherein the LEDs are disposed in an array comprising two rows of staggered LEDs.

* * * * *